US008365922B2

(12) United States Patent
Kojima et al.

(10) Patent No.: US 8,365,922 B2
(45) Date of Patent: Feb. 5, 2013

(54) CLASSIFYING METHOD AND CLASSIFYING DEVICE

(75) Inventors: Hiroshi Kojima, Kanagawa (JP); Seiichi Takagi, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 613 days.

(21) Appl. No.: 12/552,678

(22) Filed: Sep. 2, 2009

(65) Prior Publication Data

US 2010/0243539 A1 Sep. 30, 2010

(30) Foreign Application Priority Data

Mar. 26, 2009 (JP) ..... 2009-075661

(51) Int. Cl.
*B03B 5/62* (2006.01)

(52) U.S. Cl. ..... 209/157

(58) Field of Classification Search ..... 209/155, 209/157, 156
See application file for complete search history.

(56) References Cited

U.S. PATENT DOCUMENTS

| | | | | |
|---|---|---|---|---|
| 3,813,851 | A * | 6/1974 | Eder | 95/260 |
| 4,178,156 | A * | 12/1979 | Tashiro et al. | 95/59 |
| 6,727,451 | B1 * | 4/2004 | Fuhr et al. | 209/130 |
| 7,402,131 | B2 * | 7/2008 | Mueth et al. | 494/36 |
| 7,807,454 | B2 * | 10/2010 | Oh et al. | 435/308.1 |
| 7,963,398 | B2 * | 6/2011 | Robl et al. | 209/157 |
| 2006/0159601 | A1 | 7/2006 | Yamada et al. | |
| 2007/0119754 | A1 | 5/2007 | Takagi et al. | |
| 2008/0017553 | A1 | 1/2008 | Takagi et al. | |

FOREIGN PATENT DOCUMENTS

| | | |
|---|---|---|
| JP | A-49-25557 | 3/1974 |
| JP | A-54-62568 | 5/1979 |
| JP | A-55-1890 | 1/1980 |
| JP | U-1-107439 | 7/1989 |
| JP | A-07-178347 | 7/1995 |
| JP | A-08-332407 | 12/1996 |
| JP | A-11-156229 | 6/1999 |
| JP | A-11-508182 | 7/1999 |
| JP | A-2006-116520 | 5/2006 |
| JP | A-2006-187684 | 7/2006 |
| JP | A-2007-144270 | 6/2007 |
| WO | WO 97/00442 A1 | 1/1997 |

OTHER PUBLICATIONS

Office Action dated Apr. 19, 2011 in corresponding Japanese Patent Application No. 2009-075661 (with English translation).

* cited by examiner

*Primary Examiner* — Joseph C Rodriguez
*Assistant Examiner* — Kalyanavenkateshware Kumar
(74) *Attorney, Agent, or Firm* — Oliff & Berridge, PLC

(57) ABSTRACT

A classifying device having two or more classifying passages is provided, the classifying device including a first classifying passage to which particle dispersion liquid is fed; plural discharge ports provided in the first classifying passage, the plural discharge ports including a discharge port of coarse particle dispersion liquid and a discharge port of fine particle dispersion liquid; a second classifying passage; and a connecting passage that transports the coarse particle dispersion liquid to the second classifying passage, wherein the discharge port of the coarse particle dispersion liquid is provided in more upstream part of the first classifying passage than the discharge port of the fine particle dispersion liquid.

20 Claims, 8 Drawing Sheets

CLASSIFYING METHOD AND CLASSIFYING DEVICE

CROSS-REFERENCE TO RELATED APPLICATIONS

This application is based on and claims priority under 35 U.S.C. 119 from Japanese Patent Application No. 2009-075661 filed Mar. 26, 2009.

BACKGROUND

1. Technical Field

The present invention relates to a classifying method and a classifying device.

2. Related Art

A method for classifying fine particles includes a dry method and a wet method. Since a specific gravity difference between a fluid and the fine particle is large in the dry method, the dry method may be highly accurate. In the wet method, the specific gravity difference between a liquid and the fine particle is small, however, since the fine particles are easily dispersed in the liquid, a high classifying accuracy is obtained for a micro power area. The classifying device ordinarily includes a rotor of a rotating part and a stator of a stationary part to classify the fine particles by a balance between a centrifugal force and an inertia force. Further, in the dry method, the classifying device using a "Coanda effect" having no rotating part is merchandized. On the other hand, in recent years, various kinds of methods for carrying out a chemical reaction and a unit operation in a micro area are have been studied and a method and a device have been investigated for efficiently classifying the fine particles without producing impurities.

SUMMARY

According to an aspect of the present invention, there is provided a classifying device having two or more classifying passages, the classifying device including:

a first classifying passage to which particle dispersion liquid is fed;

plural discharge ports provided in the first classifying passage, the plurality of discharge ports including a discharge port of coarse particle dispersion liquid and a discharge port of fine particle dispersion liquid;

a second classifying passage; and a connecting passage that transports the coarse particle dispersion liquid to the second classifying passage from the discharge port of the coarse particle dispersion liquid, wherein an average particle diameter of particles contained in the coarse particle dispersion liquid is larger than an average particle diameter of particles contained in the particle dispersion liquid fed to the first classifying passage, an average particle diameter of particles contained in the fine particle dispersion liquid is smaller than the average particle diameter of the particles contained in the particle dispersion liquid fed to the first classifying passage, and the discharge port of the coarse particle dispersion liquid is provided in more upstream part of the first classifying passage than the discharge port of the fine particle dispersion liquid.

BRIEF DESCRIPTION OF THE DRAWINGS

Exemplary embodiments of the present invention will be described in detail based on the following figures, wherein.

DETAILED DESCRIPTION

Figure 1:
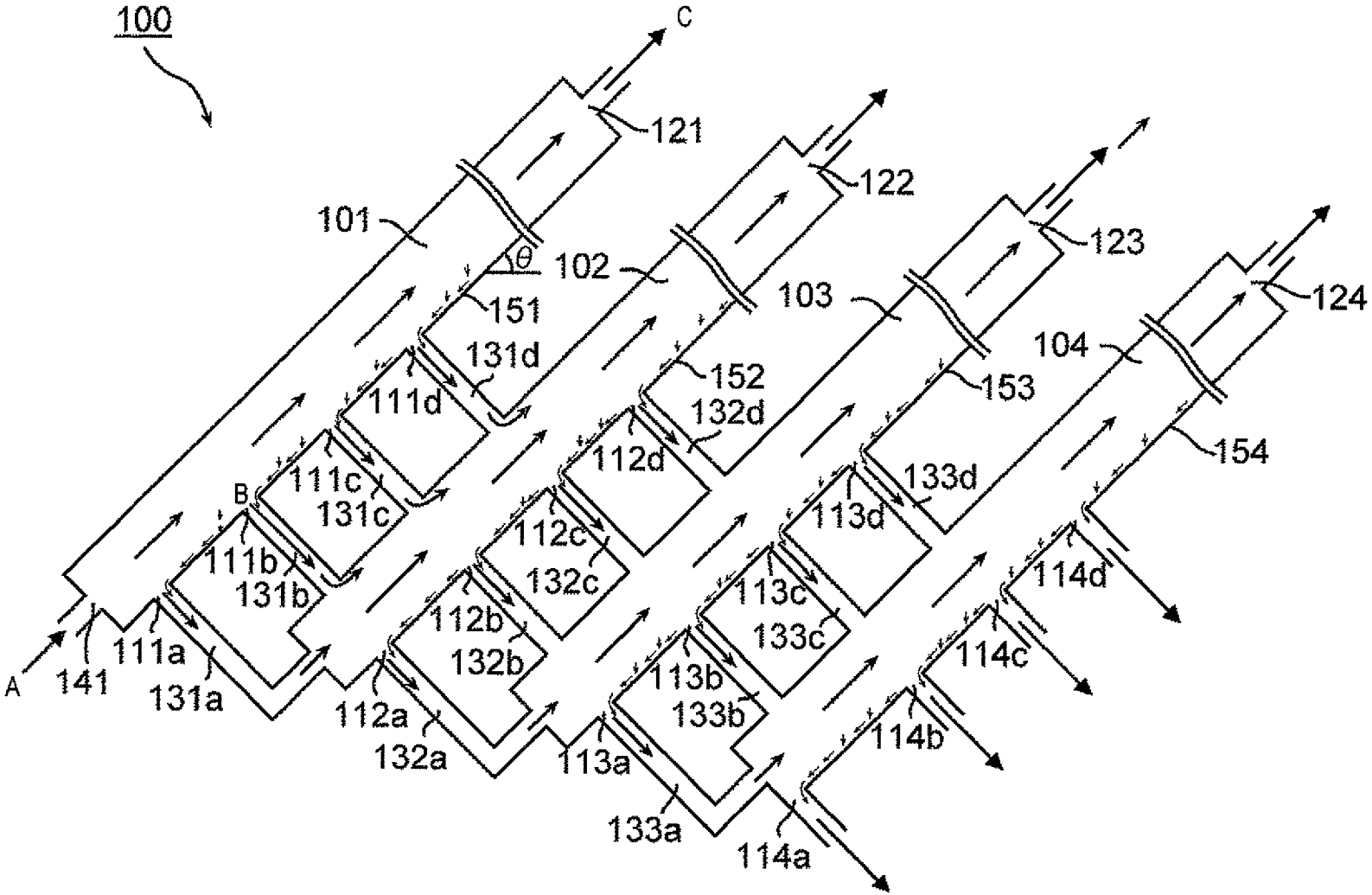
FIG. 1 is a schematic sectional view showing one example of a classifying device of an exemplary embodiment.

A classifying device of this exemplary embodiment has two or more classifying passages. A first classifying passage to which particle dispersion liquid is fed has plural discharge ports. The discharge ports provided in the first classifying passage include the discharge ports for coarse particle dispersion liquid (refer them also to as "coarse particle dispersion liquid discharge ports", hereinafter) and the discharge ports for fine particle dispersion liquid (refer them also to as "fine particle dispersion liquid discharge ports", hereinafter). The average particle diameter of particles included in the coarse particle dispersion liquid is larger than the average particle diameter of particles included in the particle dispersion liquid fed to the first classifying passage. The average particle diameter of particles included in the fine particle dispersion liquid is smaller than the average particle diameter of the particles included in the particle dispersion liquid fed to the first classifying passage. The coarse particle dispersion liquid discharge ports are provided in more upstream parts of the classifying passage than the fine particle dispersion liquid discharge ports. Connecting passages are provided for transporting the liquid to the second classifying passage from the coarse particle dispersion liquid discharge ports.

Further, a classifying method of this exemplary embodiment includes a process that feeds particle dispersion liquid to a first classifying passage of a classifying device having plural classifying passages, a process that transports the liquid in the first classifying device and classifies particles in the particle dispersion liquid, and a process that transports at least one of discharged liquids discharged from plural discharge ports provided in the first classifying device to a second classifying passage, and is characterized in that the average particle diameter of the particles included in the discharged liquid fed to the second passage is larger than the average particle diameter of the particles included in the particle dispersion liquid fed to the first classifying passage.

According to this exemplary embodiment, even when high concentration dispersion liquid is classified, a classifying efficiency is excellent. Accordingly, the dispersion liquid does not need to be prepared as dilution solution. Further, as described below, a classifying process may be carried out without transporting liquid.

In this exemplary embodiment, a dispersion medium of the dispersion liquid including the particles is simply referred to as a dispersion medium, hereinafter.

Now, referring to the drawings, the present invention will be described in detail. Unless a special description is given, the same reference numerals designate the same objects in the following explanation. Further, a description of "A to B" representing a numerical range represents "A or more and B or less" and represents a numerical range including A and B as end points.

(First Exemplary Embodiment)

FIG. 1 is a schematic sectional view showing one example of a classifying device of an exemplary embodiment.

In FIG. 1, the classifying device 100 includes four classifying passages 101, 102, 103 and 104. The classifying passages respectively include four coarse particle dispersion liquid discharge ports 111*a* to 111*d*, 112*a* to 112*d*, 113*a* to 113*d* and 114*a* to 114*d* and one fine particle dispersion liquid discharge ports 121, 122, 123 and 124.

Further, the classifying device 100 of the present exemplary embodiment includes connecting passages 131*a* to 131*d* for transporting liquid to the second classifying passage 102 from the coarse particle dispersion liquid discharge ports 111*a* to 111*d* of the first classifying passage 101. In FIG. 1, are also provided connecting passages 132*a* to 132*d* for transporting liquid to the third classifying passage 103 from the coarse particle dispersion liquid discharge ports 112*a* to 112*d* of the second classifying passage 102 and connecting passages 133*a* to 133*d* for transporting liquid to the fourth classifying passage 104 from the coarse particle dispersion liquid discharge ports 113*a* to 113*d* of the third classifying passage 103.

Further, in the first classifying passage 101, a particle dispersion liquid introducing port 141 is provided for introducing the particle dispersion liquid.

The classifying device of the present exemplary embodiment has two or more classifying passages. In FIG. 1, the classifying device 100 includes the four classifying passages 101, 102, 103 and 104, however, the present exemplary embodiment is not limited thereto and the present exemplary embodiment may include two or more classifying passages. In order to obtain a high classifying efficiency, the classifying device preferably includes 2 to 10 classifying passages, and more preferably include 4 to 7 classifying passages.

Plural classifying passages are provided so that particles may be classified in multi-stages and a higher classifying efficiency may be obtained than that by a classifying process of one stage. The particles may not be sufficiently classified by one stage. Namely, inhibiting the commingling of coarse particles with the fine particle dispersion liquid discharged from the fine particle dispersion liquid discharge ports and the improvement of a collection rate of the fine particles may not be realized together. Further, when the number of classifying passages is 7 or smaller, the residence time of the particle dispersion liquid in the classifying device is preferably short and a throughput is desirably high.

In the present exemplary embodiment, the "classifying efficiency" means a throughput per unit time (a classifying capability) and/or what is called a classifying accuracy. Here, the classifying accuracy represents what quantity of coarse powder that is desired to be removed is included in a collected part, for instance, when unnecessary coarse powder is removed. As the classifying accuracy is higher, other particles than particles having desired particle diameters are the less mixed.

In this exemplary embodiment, at least one of the classifying passages is preferably provided to have an inclination relative to a vertical direction. Namely, the classifying passage preferably has an angle relative to a horizontal direction and a vertical direction. An inclination angle of the classifying passage is larger than 0° and smaller than 90°. The inclination angle is preferably 15° or larger from the viewpoint that the particles drop along an inclined surface. Further, the inclination angle is preferably 75° or smaller from the viewpoint of obtaining a sufficient classifying efficiency. The inclination angle of the classifying passage is more preferably 20° or larger and 70° or smaller, and furthermore preferably 30° or larger and 60° or smaller. Here, the inclination of the classifying passage means an upward inclination of a bottom surface of the classifying passage relative to the direction of gravity. For instance, a horizontal passage has an inclination of 0°. An inclination angle of the upper surface of the classifying passage is not especially limited in this exemplary embodiment. Further, all the plural classifying passages are preferably provided to have inclinations relative to the vertical direction.

In FIG. 1, the inclination angle of the classifying passage is designated by θ. Further, in FIG. 1, all the four classifying passages have the inclination angle θ.

A classifying principle of the classifying device shown in FIG. 1 will be described below.

Ordinarily, when the specific gravity of the particles is large relative to the dispersion medium of the particle dispersion liquid, the particles are settled at a speed proportional to the square of the particle diameter of the particle. In the case of homogeneous particles, the particles having large particle diameters are rapidly settled. On the other hand, the particles having small particle diameters are hardly settled.

In the present exemplary embodiment, in the particle dispersion liquid, the specific gravity of the particles is larger than the specific gravity of the dispersion medium.

In FIG. 1, the particle dispersion liquid A is fed to the first classifying passage 101 from the particle dispersion liquid introducing port 141. In the present exemplary embodiment, while the particle dispersion liquid A is fed to the classifying passage, since the particles having the large particle diameters (refer them also to coarse particles) in the particle dispersion liquid A have high sedimentation speed, these particles reach a bottom surface (a lower surface in the vertical direction) 151 of the first classifying passage 101. On the other hand, the particles having the small particle diameters (refer them also to as fine particles) do not reach the bottom surface 151 and are directly discharged from the fine particle dispersion liquid discharge port 121 provided in the downstream part of the classifying passage 101.

The coarse particles reaching the bottom surface 151 of the first classifying passage 101 are settled along the bottom surface 151 of the first classifying passage in accordance with the gravity and fed to the second classifying passage 102 through the connecting passages 131*a* to 131*d* from any of the coarse particle dispersion liquid discharge ports 111*a* to 111*d*.

Here, the passage length of the classifying passage may be selected depending on various kinds of parameters such as the particle diameters of the desired particles, a difference between the specific gravity of the dispersion medium of the particle dispersion liquid introduced to the classifying device and the specific gravity of the particles and a sectional area of the classifying passage or the like, and is not especially limited. For instance, when it is an object to remove the coarse particles having a specific particle diameter or more, a sufficient distance is provided between the coarse particle dispersion liquid discharge ports and the fine particle dispersion liquid discharge port so that the coarse particles are designed not to be mixed in the fine particle dispersion liquid to be discharged. Even when the fine particles are mixed in the bully particle dispersion liquid discharged from the coarse particle dispersion liquid discharge ports 111*a* to 111*d*, since the classifying device 100 includes plural classifying passages (102 to 104), the mixed fine particles are collected as the fine particle dispersion liquid by the classifying passages (102 to 104) after the second classifying passage 102. Thus, the fine particle dispersion liquid is excellent in its collection rate and small in mixture of the coarse particles.

Further, while the particle dispersion liquid is fed to the second classifying passage 102, the coarse particles are settled in the direction of gravity in the second classifying passage 102 as in the feed of the liquid in the first classifying passage 101 and transported to the coarse particle dispersion liquid discharge ports 112*a* to 112*d*. On the other hand, the fine particles are fed to the fine particle dispersion liquid discharge port 122. In FIG. 1, 152, 153 and 154 denote bottom surfaces of the second, third and fourth classifying passages 102, 103 and 104 respectively.

In the classifying device shown in FIG. 1, the particle dispersion liquid A is supplied from the particle dispersion liquid introducing port 141 provided in a lower part of the classifying device 100. An introducing method for the particle dispersion liquid A is not especially limited and may be suitably selected from known methods. The particle dispersion liquid A is preferably introduced under pressure by a micro cylinder, a rotary pump, a screw pump, a centrifugal pump, a piezo-pump or the like.

The particle dispersion liquid is preferably fed from a lower part to an upper part from the viewpoint that the particles included in the particle dispersion liquid are settled. To transport the particle dispersion liquid from the lower part to the upper part does not mean only a case that the particle dispersion liquid is fed in a vertical direction. Assuming that the particle dispersion liquid fed in a horizontal direction has a flow vector of 0°, the particle dispersion liquid fed from the lower part to the upper part in the vertical direction has a flow vector of 90° and the particle dispersion liquid fed from the upper part to the lower part in the vertical direction has a flow vector of −90°, to transfer the particle dispersion liquid from the lower part to the upper part means that the flow vector is larger than at least 0° and 90° or smaller. The flow vector has the same preferable range as that of the inclination angle of the bottom surface of the classifying passage.

In the present exemplary embodiment, the coarse particle dispersion liquid discharge ports 111*a* to 111*d* are provided in parts more upstream than the fine particle dispersion liquid discharge port 121. In this exemplary embodiment, since the particles are classified by using the sedimentation speed difference of the particles, the discharge ports of the coarse particle dispersion liquid (the coarse particle dispersion liquid discharge ports) 111*a* to 111*d* including the coarse particles having higher sedimentation speed are provided in upstream parts. The discharge port of the fine particle dispersion liquid (the fine particle dispersion liquid discharge port) 121 including the fine particles having lower sedimentation speed is provided in a downstream part.

In all the classifying passages, the coarse particle dispersion liquid discharge ports are preferably provided in the parts more upstream than the fine particle dispersion liquid discharge ports. Specifically, in any of the first classifying passage to the fourth classifying passage, the coarse particle dispersion liquid discharge ports (111*a* to 111*d*, 112*a* to 112*d*, 113*a* to 113*d* and 114*a* to 114*d*) are respectively provided in the upstream parts of the fine particle dispersion liquid discharge ports (121, 122, 123 and 124).

The average particle diameter ($R_A$) of the particle dispersion liquid A introduced to the first classifying passage 101, the average particle diameter ($R_B$) of the coarse particle dispersion liquid B discharged from the coarse particle dispersion liquid discharge ports 111*a* to 111*d* and the average particle diameter ($R_C$) of the fine particle dispersion liquid C discharged from the fine particle dispersion liquid discharge port 121 satisfy a below-described relational expression.

$$R_C<R_A<R_B$$

Here, when plural coarse particle dispersion liquid discharge ports are provided in one classifying passage, an entire part of the coarse particle dispersion liquids discharged from all the coarse particle dispersion liquid discharge ports satisfies the above-described relation. Further, when plural fine particle dispersion liquid discharge ports are provided in one classifying passage, an entire part of the fine particle dispersion liquids discharged from all the fine particle dispersion liquid discharge ports similarly satisfies the above-described relation.

In the present exemplary embodiment, the diameter of a section of the classifying passage corresponding to a circle (the diameter of a circle having the sectional area of the classifying passage) is preferably 10 μm to 20 cm, more preferably 100 μm to 1 cm and furthermore preferably 1 mm to 5 mm.

When the diameter of the section of the classifying passage corresponding to the circle is located within the above-described range, the sedimentation distance of the particles in the particle dispersion liquid is preferably short and a time necessary for the particles to be settled to a passage wall is drastically reduced to increase efficiency. Further, even when a flow velocity is high, a laminar flow may be maintained so that the deterioration of the classifying capability due to a turbulent flow may be prevented. Further, under the laminar flow, the flow velocity of the particles is preferably substantially zero in a wall surface to improve the classifying efficiency.

Here, assuming that the sectional area of the classifying passage is A, the diameter a of the section corresponding to the circle is given by a below-described equation.

$$a = 2\sqrt{\frac{A}{\pi}}$$

Specifically, a preferable passage size (a sectional area of the passage, a width of the passage, etc.) is determined by a time required for the particles to be processed are settled and reach the bottom surface.

When the particles are processed for time t (sec), assuming that the sedimentation speed of the particles to be processed is v (m/s), the height h (m) of the passage is expressed by an equation (1). When a circular pipe is used, the height h of the passage corresponds to the diameter of a circle.

$$h=vt \tag{1}$$

The sedimentation speed v of the particles is expressed by a below-described equation (2) in an area of low Reynolds number in accordance with the Stokes' equation. Here, D (cm) represents a diameter of a particle to be processed, $\rho_p$ (g/cm$^3$) represents a particle density, $\rho_d$ (g/cm$^3$) represents a density of the dispersion medium, μ (g/cm■sec) represents a coefficient of viscosity of the dispersion medium and g (m/s$^2$) represents acceleration of gravity.

$$v = \frac{(\rho_p - \rho_d)g}{18\mu} D^2 \quad (2)$$

Figure 8:
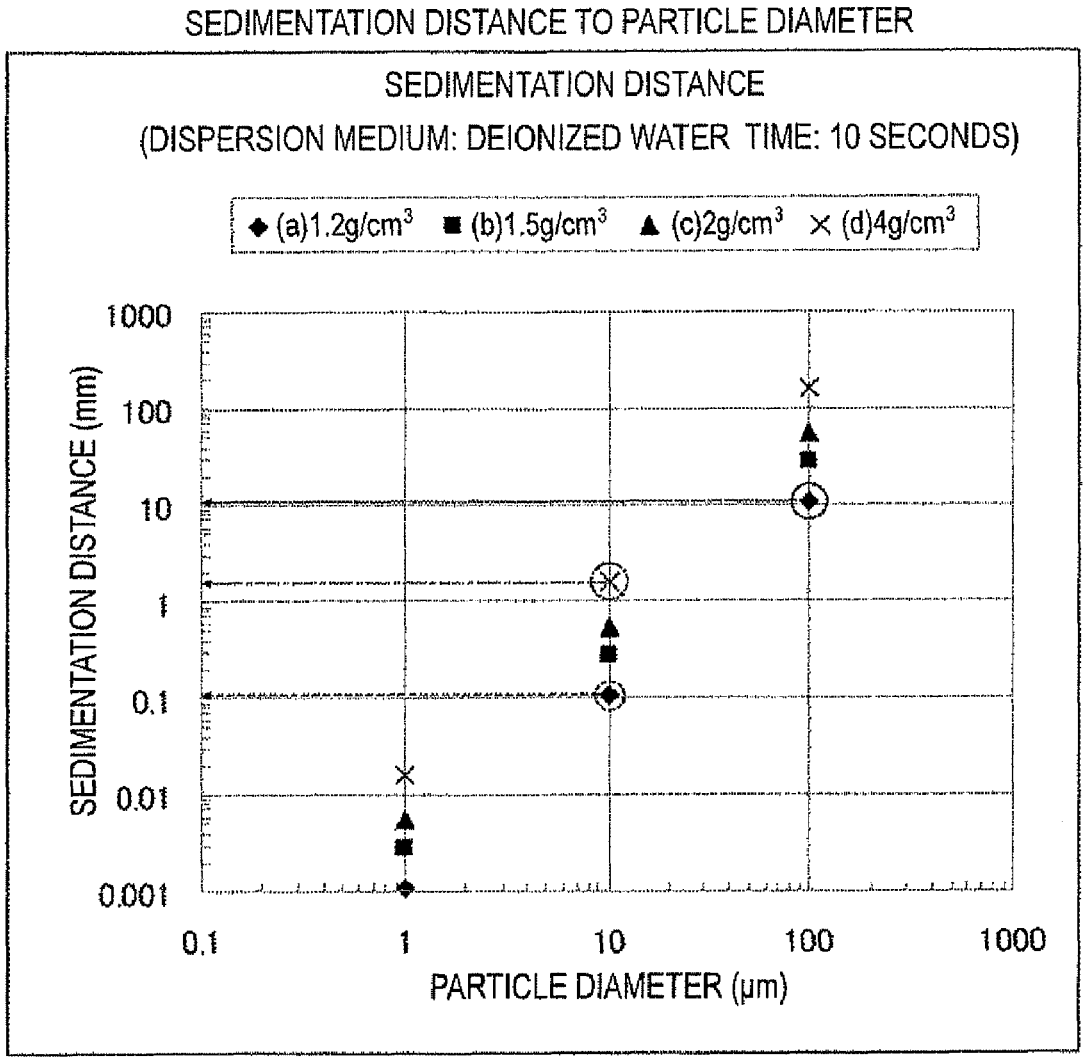
FIG. 8 is a diagram showing a relation between a sedimentation distance and a particle diameter.

Here, it is assumed that a processing time is desired to be set to 10 seconds. When the dispersion medium is deionized water ($\rho_d$=1, $\mu$=0.01), the particle density is 1.2 g/cm$^3$ ((a) in the drawing, acryl or the like), 1.5 g/cm$^3$ ((b) in the drawing), 2 g/cm$^3$ ((c) in the drawing, silica or the like) and 4 g/cm$^3$ ((d) in drawing, alumina or the like), respectively, a relation between the height (the sedimentation distance) h and the particle diameter D is shown in FIG. 8.

From this graph, for instance, when acrylic resin particles having the particle diameter of about 10 μm are processed, since the sedimentation distance is about 0.1 mm (an arrow mark shown by a dotted line in FIG. 8), the height of several tens to several hundreds μm is necessary. Further, in the case of heavy particles such as alumina, even when the particle diameter is 10 μm equal to that of the acrylic resin particles, the sedimentation distance is about 2 mm (an arrow mark shown by a dashed line in FIG. 8) and the height on the order of about 2 mm is required. Further, when the particle diameter of the acrylic resin particle is increased to a size as large as 100 μm, the sedimentation distance is 10 mm (an arrow mark shown by a full line in FIG. 8), the height on the order of mm to cm is required.

Here, the particles are supposed to be processed in ten seconds, however, when the particles are processed in 100 seconds (on the order of minute), the sedimentation distance is increased by one figure order, and the diameter of the circular pipe is also increased by one figure order. When an ordinary processing speed is considered, the order of 100 seconds is substantially a limit. It is not realistic to require more processing time. As described above, as the passage size, there are optimum sizes on the order of several tens μm to several cm depending on the specific gravity or the size of the particle. Further, as the passage size, a desired passage size is preferably selected in accordance with the above-described parameters.

In this exemplary embodiment, the sectional form of the classifying passage is not especially limited, however, a circular form or a rectangular form is preferable from the viewpoint that the device is easily manufactured. Further, the sectional forms of the connecting passages and a below-described circulating passage are not especially limited, however, a circular form or a rectangular form is preferable from the viewpoint that the device is easily manufactured.

In FIG. 1 and below-described FIG. 2, the first classifying passage to the fourth classifying passage and the connecting passages have the sections of circular forms (tubular).

The classifying passage may have the same sectional area from the upstream part to the downstream part of the classifying passage. In the upstream part or the downstream part of the passage, the sectional area of the passage may be increased or decreased and is not especially limited. The sectional area of the passage in the downstream part is preferably larger than that of the upstream part from the viewpoint of improvement of the processing speed. Particularly, as described below, when a dilution solution discharge port is provided, the sectional area of the downstream part of the classifying passage is preferably larger than the sectional area of the passage in the upstream part of the classifying passage. A detail thereof will be described below.

In the present exemplary embodiment, a fluid (the particle dispersion liquid) in the classifying passage is fed in a laminar flow.

Since, under the laminar flow, the speed of the particles is substantially zero in the vicinity of the wall surface, the particles colliding with the bottom surface drop along the inclined surface due to the gravity, and are discharged from the discharge ports provided in the classifying passage.

The classifying passage is, as described above, preferably provided to have an inclination relative to the vertical direction. In other words, the classifying device of this exemplary embodiment preferably includes a classifying process that allows the dispersion liquid to pass the classifying passage having the inclination relative to the vertical direction and classifies the particles.

In the present exemplary embodiment, the particle dispersion liquid fed in the classifying passage preferably has the Reynolds number of 1,000 or smaller. The Reynolds number is more preferably $1\times10^{-5}$ to 100 and furthermore preferably $1\times10^{-5}$ to 10.

Particularly, when the Reynolds number is 2,300 or smaller, the fluid fed in the classifying passage is governed not by the turbulent flow, but by the laminar flow.

Since a micro passage has a micro scale, a dimension (a representative length) is small. Thus, even when the flow velocity is high, the Reynolds number is 2,300 or smaller. Accordingly, the classifying device having the passage of the micro scale is not governed by the turbulent flow as in an ordinary rector, but by the laminar flow.

Here, the Reynolds number (Re) is obtained in such a way as described below. When the Reynolds number is 2,300 or smaller, the classifying device is governed by the laminar flow.

The Reynolds number (Re) is proportional to the flow velocity (u(m/s) and the representative length (L(m)).

$$Re = \frac{uL}{v} \quad (3)$$

Here, v represents a coefficient of kinematic viscosity (m$^2$/c) of the fluid. When the passage has a rectangular section, the representative length (L (m)) is prescribed by a below-described equation.

$$L = \frac{4S}{l_p} \quad (4)$$

Here, S represents a sectional area (m$^2$) and $l_p$ represents the length of a periphery (m). Assuming that the width of the rectangular section of the passage is x (m) and the height is h (m), a below-described equation (5) is established.

$$S = hx \quad l_p = 2(x+h) \quad (5)$$

Assuming that the flow rate of the fluid is a (m$^3$/s), a below-described equation (6) is established.

$$u = \frac{a}{S} \quad (6)$$

When the equation (4), the equation (5) and the equation (6) are substituted for the equation (3), a below-described equation (7) is derived.

$$Re = \frac{2a}{v} \cdot \frac{1}{x+h} \quad (7)$$

Here, the deionized water is supposed to be fed to the passage having a rectangular form at a prescribed flow velocity (for instance, 10 ml/h) The coefficient of kinematic viscosity of the deionized water at 25° C. is $0.893\times10^{-7}$ $m^2/s$.

When the height h of the passage is constant and the width x of the passage is a variable, the Reynolds number is inversely proportional to the width of the passage.

In such a way, the passage in which the Reynolds number is 2,300 or smaller may be designed. When the height h is sufficiently small, even if the width x of the passage is increased, the laminar flow may be maintained.

A preferred form of the present exemplary embodiment will be more specifically described below.

When the particles having desired particle diameters or smaller are collected from the dispersion liquid, if the dispersion liquid is fed in the classifying passage from the lower part to the upper part in the direction opposite to the direction of gravity (this maybe occasionally expressed by a "upward flow") the particles whose terminal speed is lower than the speed of the upward flow ride on the upward flow and are fed to the upper part of the classifying passage. On the other hand, the particles whose terminal speed is higher than the speed of the upward flow are settled in the direction of gravity. In the upper part of the classifying passage, a discharge passage is provided so that the particles having prescribed particle diameters or smaller may be collected. Further, in the lower part of the classifying passage, a discharge passage is provided so that the particles having prescribed particle diameters or smaller may be collected. Further, the classifying passage has the inclination relative to the direction of gravity, so that the speed of the upward flow may be lowered and the particles may be efficiently classified.

The classifying device and the classifying method of the present exemplary embodiments classify the particles in the dispersion liquid by using the classifying passages and employing the difference of the sedimentation speed of the particles. In the present exemplary embodiment, the dispersion liquid needs to be essentially fed in a laminar flow in all the classifying passages and is preferably supplied in the flows in all the classifying passages.

In the present exemplary embodiment, when the bottom surface of the classifying passage has the inclination, the particles that come into contact with the inclined surface due to the sedimentation are settled along the bottom surface of the classifying passage, that is, the inclined wall surface. As described above, since, under, the laminar flow, the flow velocity of the particles is substantially zero in the wall surface, when the dispersion liquid fed to the classifying passage is governed by the laminar flow, the particles in contact with the bottom surface of the classifying passage hardly receive the influence of the upward flow and are settled in accordance with the gravity depending on the difference of the specific gravity from that of the dispersion medium. Accordingly, the particles may be classified in a shorter length of the passage than that of a usual sedimentation classifying device and the particles may be classified in a shorter time.

When the specific gravity of the particles is higher than that of the dispersion medium, the particles are settled. The sedimentation speed at that time is different depending on the specific gravity of the particles or the particle diameter. In the present exemplary embodiment, the particles are classified by using the difference of the sedimentation speed. When the particle diameters are different, the sedimentation speed is proportional to the square of the particle diameter. The particles having the large particle diameters are the more quickly settled.

In the present exemplary embodiment, not only the difference of the sedimentation speed is used, but also an external force proportional to the particle diameter of the particle is applied to the particles so that the width of the particle to which the classifying method may be applied is increased. As such an external force, an electric field or a magnetic field may be exemplified.

<Substitute Fluid>

When the particles are settled, since the fluid flows into a position where the particles have been so far, a microscopic upward flow arises. This phenomenon is called a boycott effect that causes the particles to be agitated even under the laminar flow and the classifying efficiency to be deteriorated. Thus, especially, under a high concentration (5 wt % or higher), the classifying efficiently is extremely deteriorated.

As compared therewith, in the classifying device of the present exemplary embodiment, since the particles are separated under the upward flow, the influence of the boycott is suppressed so that the separation of the particles may be highly efficiently carried out.

<Particle>

In the present exemplary embodiment, the size of the particles to be classified is not especially limited, however, the particle diameter of the particle (a diameter or a maximum particle diameter) is preferably 0.1 μm or larger and 1,000 μm or smaller. The classifying device and the classifying method of the present exemplary embodiment are more preferably suitable for classifying the particles of the particle diameter of 1 μm or larger and 100 μm or smaller, and furthermore preferably suitable for classifying the particles of the particle diameter of 5 μm or larger and 20 μm or smaller.

When the particle diameter of the particles is 1,000 μm or smaller, the occurrence of the clogging of the passage may be preferably suppressed. On the other hand, when the particle diameter of the particles is 0.1 μm or larger, the particles preferably hardly adhere to the wall surface.

The kinds of the particles to be classified are not especially limited. Resin fine particles, inorganic fine particles, metal fine particles, ceramic fine particles, cells (for instance, lymph, leucocyte, erythrocyte or the like) may be exemplified without a special limitation. Further, a biological sample (all blood) or a suitably diluted biological sample may be used as dispersion liquid.

Further, polymer fine particles, crystals or aggregates of an organic material such as a pigment, crystals or aggregates of an inorganic material, fine particles of metal compounds such as metal oxide, metal nitride, etc. and toner particles may be classified.

Further, forms of the particles are not especially limited and any of spherical forms, rotary elliptic forms, monolithic forms, pin-shaped forms or the like may be employed. Since the passage is hardly clogged by the particles of the spherical forms or the rotary elliptic forms among them, the particles preferably have the spherical forms and/or the rotary elliptic forms. The ratio of the length of a major axis to the length of a minor axis (the length of the major axis/the length of the minor axis) is preferably 1 or larger and 50 or lower, and more preferably 1 or larger and 20 or smaller.

As the polymer fine particles, may be specifically exemplified the fine particles of a polyvinyl butyral resin, a polyvinyl acetal resin, a polyallylate resin, a polycarbonate resin, a polyester resin, a phenoxy resin, a polyvinyl chloride resin, a polyvinylidene chloride resin, a polyvinyl acetate resin, a polystyrene resin, an acryl resin, a methacryl resin, a styrene-acryl resin, a styrene-methacryl resin, a polyacryl amide resin, polyamide resin, a polyvinyl pyridine resin, a cellulose resin, a polyurethane resin, an epoxy resin, a silicone resin, a polyvinyl alcohol resin, casein, a vinyl chloride-vinyl acetate copolymer, a modified vinyl chloride-vinyl acetate copolymer, a vinyl chloride-vinyl acetate-maleic anhydride copolymer, a styrene-butadinene copolymer, a vinylidene chloride-acrylonitrile copolymer, a styrene-alkyd resin, a phenol-formaldehyde resin, etc.

Further, as the fine particles of metal or the metal compounds, may be exemplified the fine particles of metal such as carbon black, zinc, alumina, copper, iron, nickel, chromium, titanium, etc. or alloys of them, metal oxides such as $TiO_2$, $SnO_2$, $Sb_2O_3$, $In_2O_3$, ZnO, MgO, iron oxide or compounds of them, metal nitride such as silicon nitride or combinations thereof.

The fine particles are produced by many methods. In most of cases, the fine particles are produced in a medium liquid (the dispersion medium) by a synthesis and the fine particles are directly classified. The fine particles produced by mechanically cracking a massive material may be occasionally dispersed in the medium liquid to be classified. In this case, the massive material is frequently cracked in the medium liquid (the dispersion medium) and directly classified.

On the other hand, when a power material (the fine particles) produced by the dry method is classified, the powder material needs to be previously dispersed in the medium liquid. As a method for dispersing the dry powder material in the medium liquid, may be exemplified a sand mill, a colloid mill, an attritor, a ball mill, a diner mill, a high pressure homogenizer, an ultrasonic disperser, a cobble mill, a roll mill, etc. At this time, the powder material is preferably dispersed in the medium liquid under a condition that primary particles are not ground by the dispersion.

<Dispersion Medium>

As the dispersion medium of the particle dispersion liquid including the particles, any solvent may be used without special limitation, however, the solvent is used whose specific gravity is smaller than that of at least one kind of the particles in the dispersion liquid. The solvent is preferably used whose specific gravity is smaller than those of all the particles in the dispersion liquid.

A difference obtained by subtracting the specific gravity of the dispersion medium or the transporting liquid from the specific gravity of the particle is preferably respectively 0.01 or larger. A specific gravity difference is preferably large so that the sedimentation speed of the particles is high. However, the specific gravity difference is preferably 20 or smaller. The specific gravity difference is more preferably 0.05 to 11 and further more preferably 0.05 to 4. When the difference obtained by subtracting the specific gravity of the dispersion medium or the transporting liquid from the specific gravity of the particle is 0.01 or larger, the particles are preferably settled. On the other hand, when the difference is 20 or smaller, the sedimentation speed is preferably proper so that the clogging hardly occurs.

As the dispersion medium and the transporting liquid, the dispersion liquid and the transporting liquid in which the difference obtained by subtracting the specific gravity of the dispersion medium from the specific gravity of the particle is 0.01 to 20 may be preferably used as described above. For instance, water, aqueous medium, an organic solvent medium or the like may be exemplified.

As the water, may be exemplified ion exchanged water, distilled water, electrolytic ion water or the like. Further, as the organic solvent medium, may be specifically exemplified methanol, ethanol, n-propanol, n-butanol, benzyl alcohol, methyl cellosolve, ethyl cellosolve, acetone, methyl ethyl ketone, cyclohexanone, methyl acetate, n-butyl acetate, dioxane, tetrahydrofuran, methylene chloride, chloroform, chlorobenzene, toluene, xylene, etc. and mixtures of two or more kinds of them.

In the present exemplary embodiment, a preferable dispersion medium is different depending on the kinds of the particles to be classified. As the preferable dispersion medium for each kind of the particles, may be preferably exemplified an aqueous medium that does not dissolve the particles, organic solvents such as alcohol, xylene, etc., acidic or alkaline water or the like as the dispersion medium combined with polymer particles (ordinarily, the specific gravity is about 1.05 to 1.6).

Further, as the dispersion medium combined with the particles of the metal or the metal compounds (ordinarily, the specific gravity is about 2 to 10), may be preferably exemplified water that does not damage the metal by oxidization or reduction, organic solvents such as alcohol, xylene, etc., or oil.

In the present exemplary embodiment, preferably, the classifying passage does not have a transporting liquid introducing port. Here, the transporting liquid indicates a solvent including no particles and fed to the classifying passage.

The transporting liquid is used so that a quantity of the fluid fed to the classifying passage is increased. Thus, since a throughput per unit time is lowered, it is preferable in the exemplary embodiment that the transport is not fed.

In the classifying device 100 shown in FIG. 1, the section of each of the classifying passages 101 to 104 is circular and a diameter thereof is 5 mm. The length of the classifying passage is 150 mm. Further, the diameters of the fine particle dispersion liquid discharge port and the coarse particle dispersion liquid discharge port are 1 mm.

In the first exemplary embodiment, the specific gravity of the particles included in the dispersion liquid, the diameter of the particle, the specific gravity of the dispersion medium and the transfer speed of the dispersion liquid are suitably selected so that the particles of desired particle diameters may be classified. Further, when the length of the classifying passage is larger, the classifying capability is the more increased. However, when the length of the classifying passage is lengthened, a volume required for the classifying device is increased. Accordingly, the length of the classifying passage is preferably suitably selected depending on a purpose.

(Second Exemplary Embodiment)

Figure 2:
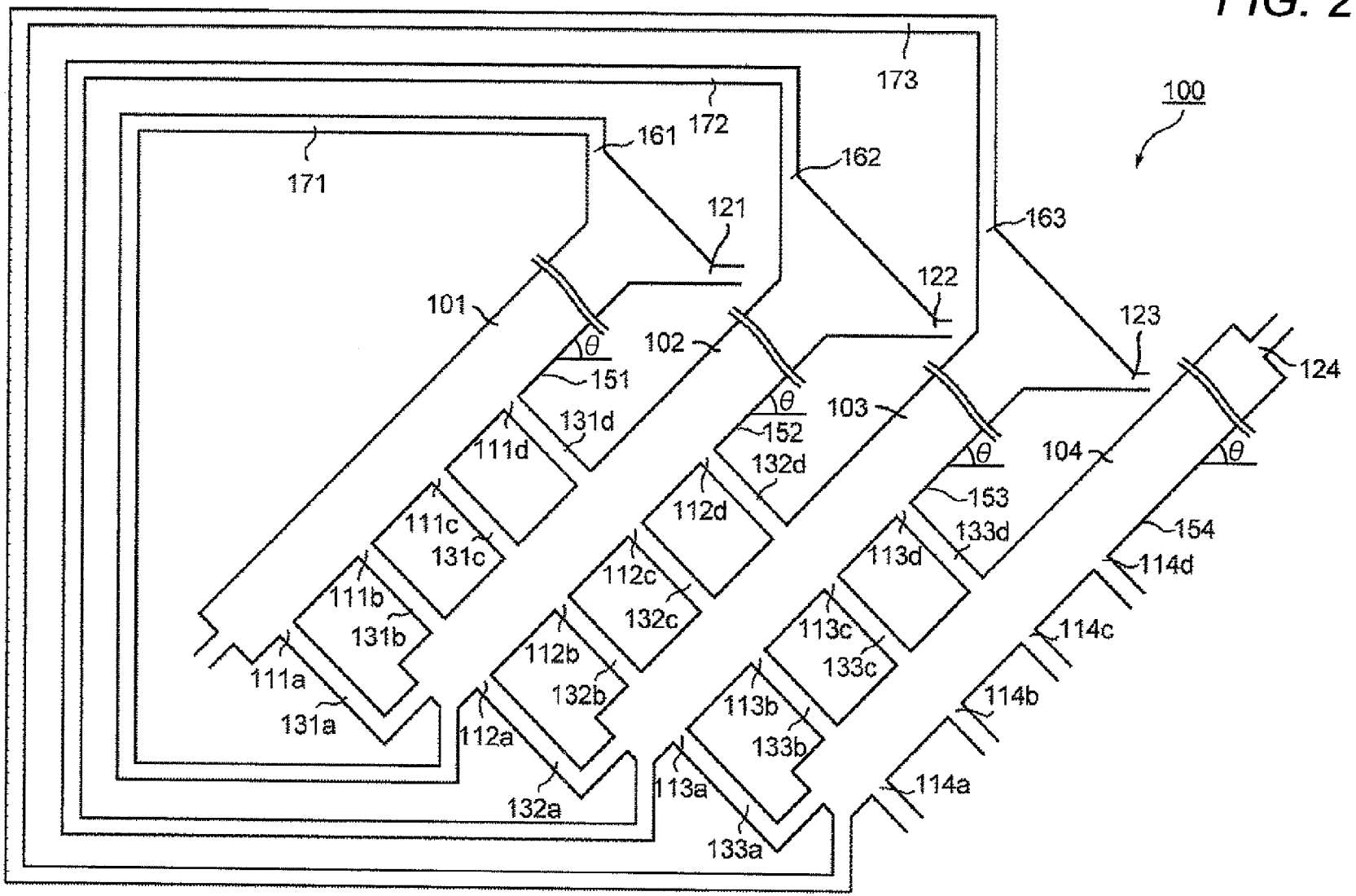
FIG. 2 is a schematic sectional view showing another example of the classifying device of the exemplary embodiment.

FIG. 2 is a schematic sectional view showing another preferred example of the present exemplary embodiment. This exemplary embodiment is different from the first exemplary embodiment shown in FIG. 1 with respect to three points described below.

(1) The sectional area of a passage is increased in a downstream part of a classifying passage.

(2) In the downstream part of the classifying passage, a discharge port of dilution liquid is provided as well as a fine particle dispersion liquid discharge port.

(3) A circulating passage is provided for transporting the liquid to other classifying passage from the discharge port of the dilution liquid.

In a classifying device 100 shown in FIG. 2, in a first classifying passage 101 to a fourth classifying passage 104, coarse particle dispersion liquid discharge ports (111*a* to 111*d*, 112*a* to 112*d*, 113*a* to 113*d* and 114*a* to 114*d*) and fine particle dispersion liquid discharge ports (121, 122, 123 and 124) are provided as in FIG. 1. In the first classifying passage 101 to the third classifying passage 103, the sectional areas of the passages are increased in the downstream parts.

When the classifying passage has its section more increased in an advancing direction of dispersion liquid, below-described advantages are obtained. Namely, when the transport speed of the dispersion liquid is low, since a dispersion liquid introducing passage and/or the classifying passage is occasionally clogged with particles, the transport speed of the dispersion liquid needs to be set to such a speed not to generate a clogging. On the other hand, when the transport speed of the dispersion liquid is too high, the transport speed exceeds the terminal speed of the particles, and accordingly, the particles may not be sufficiently classified.

When the sectional area of the classifying passage is increased relative to the advancing direction of the dispersion liquid, as the dispersion liquid is fed to a more downstream part, a flow velocity is the lower. Accordingly, even when the transport speed of the dispersion liquid is increased in an upstream part, the particles may be sufficiently classified and a classifying efficiency may be improved by suppressing the clogging.

Further, in the downstream part of the classifying passage, the discharge port of the dilution liquid (express it as a "dilution liquid discharge port", hereinafter) 161 is provided as well as the fine particle dispersion liquid discharge port 121. The dilution liquid discharge port is preferably provided in an upper surface (an upper part in a vertical direction) of the classifying passage.

The concentration (wt %) of the particles included in the dilution liquid discharged from the dilution liquid discharge port 161 is preferably lower than the concentration (wt %) of the particles of fine particle dispersion liquid discharged from the fine particle dispersion liquid discharge port 121. A lower concentration of the particles that are included in the dilution liquid is the more preferable. From the viewpoint that the dilution liquid is fed to the circulating passage and fed to the second classifying passage, a diameter of the dilution liquid discharge port and a position where the dilution liquid discharge port is proved may be suitably selected.

In FIG. 2, the first classifying passage 101 further has a circulating passage 171 for transporting the dilution liquid to the second classifying passage 102.

The present exemplary embodiment is not limited to a form in which the dilution liquid discharged from the first classifying passage 101 is fed to the second classifying passage 102. The dilution liquid discharged from the first classifying passage 101 may be fed to the first classifying passage 101, and may be fed to the third classifying passage 103 or the fourth classifying passage 104. From the viewpoint that the concentration of the particles of the particle dispersion liquid fed to the classifying passage is properly maintained among them, the dilution liquid discharged from the first classifying passage is preferably fed to the second classifying passage. Similarly, the dilution liquid discharged from the second classifying passage 102 is preferably fed to the third classifying passage 103 through a circulating passage 172. The dilution liquid discharged from the third classifying passage 103 is preferably fed to the fourth classifying passage 104 through a circulating passage 173.

Further, in FIG. 2, in the fourth classifying passage 104, a dilution liquid discharge port and a dilution liquid circulating passage are not provided, however, a circulating passage may be provided for transporting the dilution liquid to the first classifying passage 101 from the fourth classifying passage 104. In this case, since a throughput per unit time is lowered as an entire part of the classifying device, a processing capability per unit time is not preferably deteriorated, for instance, by increasing the concentration of the particles of the particle dispersion liquid fed to the first classifying passage.

The classifying device having the circulating passage will be described in more detail.

In the exemplary embodiment, the fine particle dispersion liquid discharged from the fine particle dispersion liquid discharge port 121 is preferably provided in a sufficiently downstream part in order to prevent the particles (coarse particles) having desired particle diameters or larger from being mixed. In this case, when a quantity of the fine particle dispersion liquid discharged from the fine particle dispersion liquid discharge port 121 is considered, the concentration of the particles of coarse particle dispersion liquid fed to the second classifying passage 102 may be occasionally higher than that of the particle dispersion liquid A fed to the first classifying passage 101.

When the concentration of the particles of the particle dispersion liquid fed to the classifying passage and a connecting passage is high, an interaction between the particles may arise to lower a classifying efficiency. Further, the classifying passage and the connecting passage may be occasionally clogged with the particles. Accordingly, it is preferable to prevent the concentration of the particles in the particle dispersion from being excessively high. In the present exemplary embodiment, since the dilution liquid is fed to the second classifying passage through the circulating passage, the concentration of the particles in the particle dispersion liquid fed to the second classifying passage is lowered. As a result, the classifying efficiency is preferably improved. In FIG. 2 132 and 163 denote discharge ports of the dilution liquid of second and third classifying passages 102 and 103, respectively.

(Third Exemplary Embodiment)

Figure 3A:
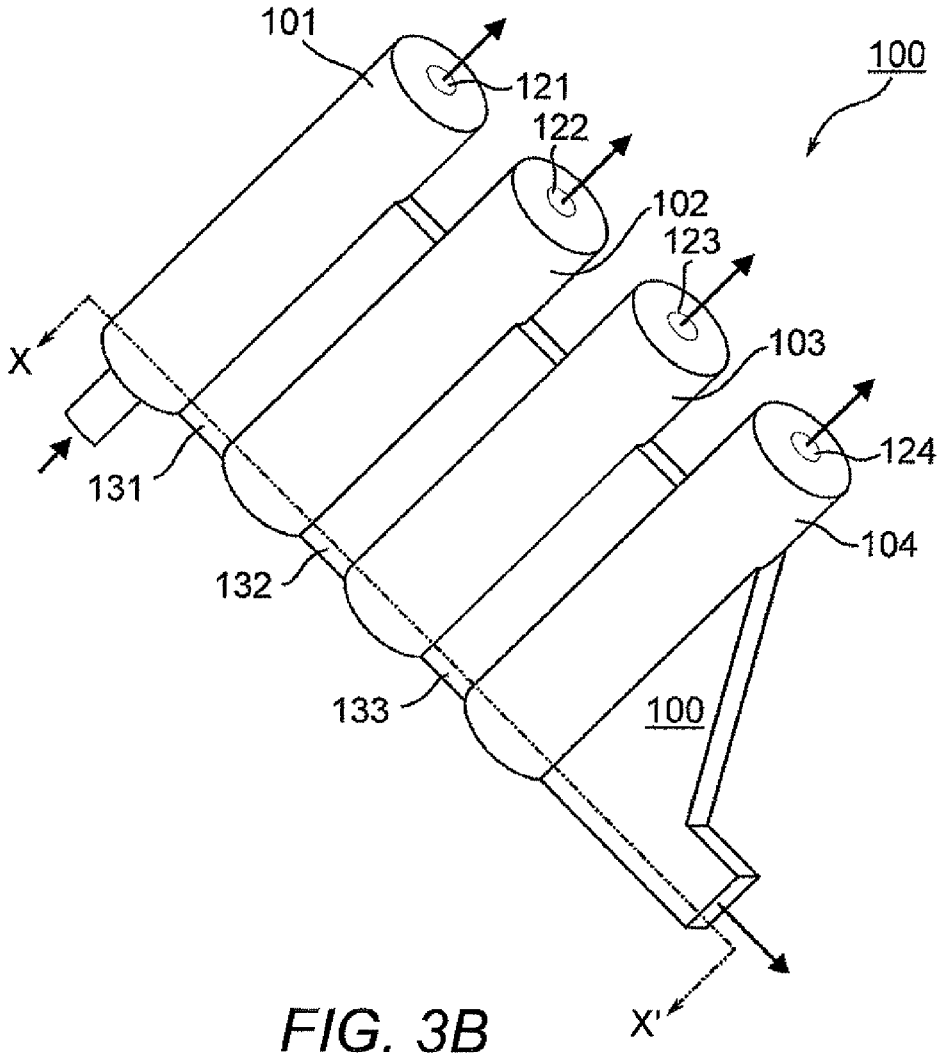
FIGS. 3A and 3B are schematic views showing other example of the classifying device of the exemplary embodiment.
Figure 3B:
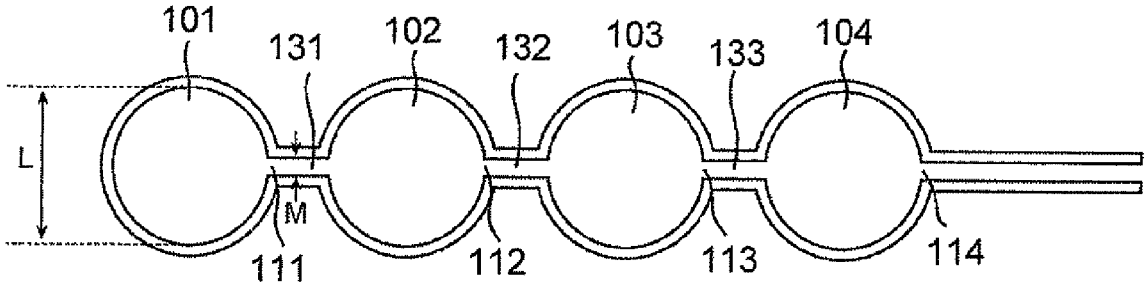

FIGS. 3A and 3B are schematic views showing other preferred example of the classifying device of the present exemplary embodiment. FIG. 3A is a perspective view and FIG. 3B is a sectional view taken along a line X-X' of FIG. 3A.

In FIGS. 3A and 3B, a coarse particle dispersion liquid discharge port 111 of a first classifying passage 101 is provided in a slit form in a bottom surface side in a vertical direction of the classifying passage 101 having a circular section. Further, a connecting passage 131 transports coarse particle dispersion liquid to a second classifying passage 102 from the discharge port 111.

As shown in FIGS. 3A and 3B, the coarse particle dispersion liquid discharge port of the slit form is provided so that the discharge efficiency of the coarse particle dispersion liquid is preferably improved and a pressure difference from the first classifying passage 101 to a fourth classifying passage 104 may be preferably decreased.

In FIGS. 3A and 3B, the length of the classifying passage, the sectional area of the passage, the width of the slit, the length of the slit or the like may be suitably selected in accordance with a desired particle size, a liquid transport speed determined from the difference of specific gravity between a dispersion medium and particles, the viscosity of the dispersion medium, etc. When toner particles having the particle diameters of 1 to 50 μm are fed by using water as the dispersion medium, a ratio (L:M) of the diameter of a section of the classifying passage (L in FIG. 3B) to the width of the slit (M in FIG. 3B) is preferably set to 5:1 or so.

(Fourth Exemplary Embodiment)

Figure 4A:
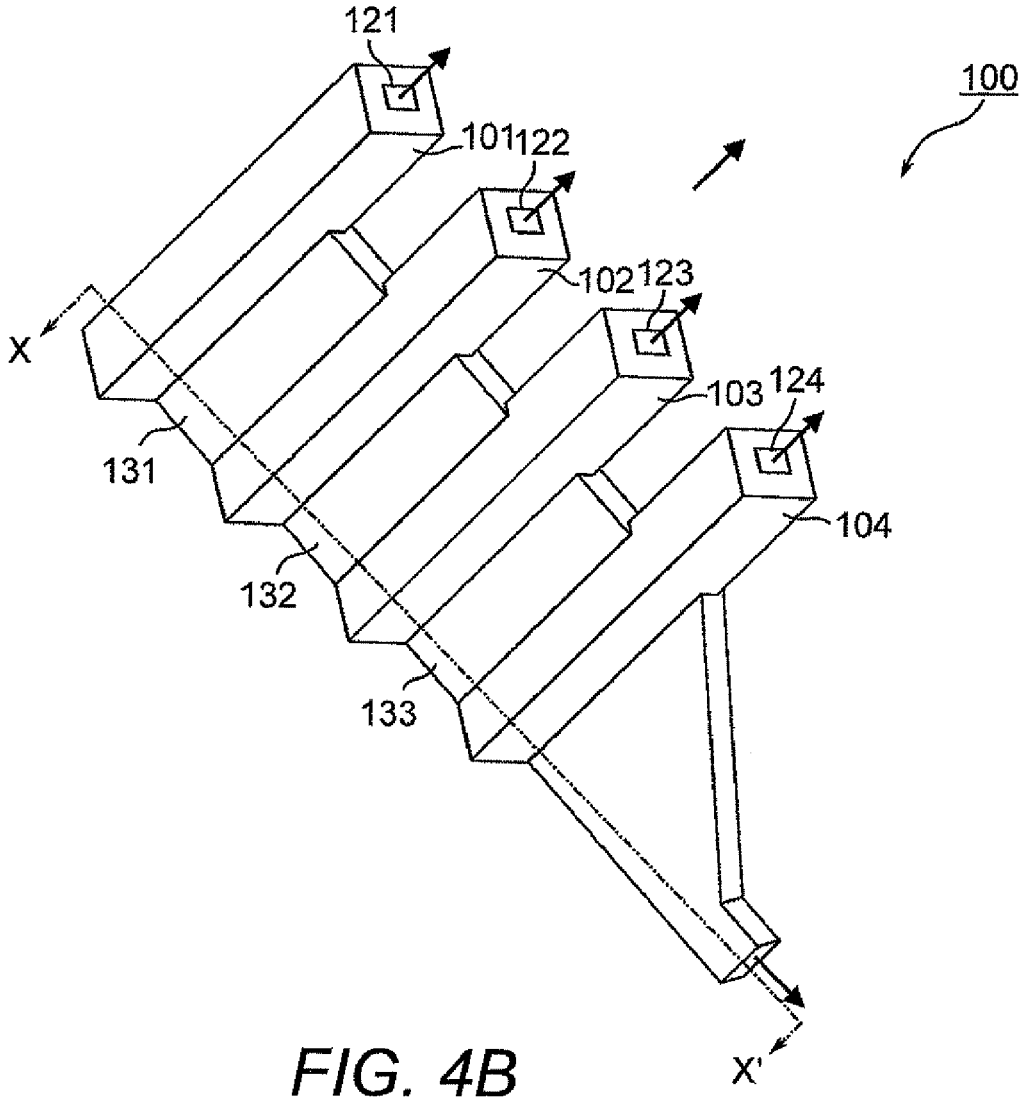
FIGS. 4A and 4B are schematic views showing other example of the classifying device of the exemplary embodiment.
Figure 4B:
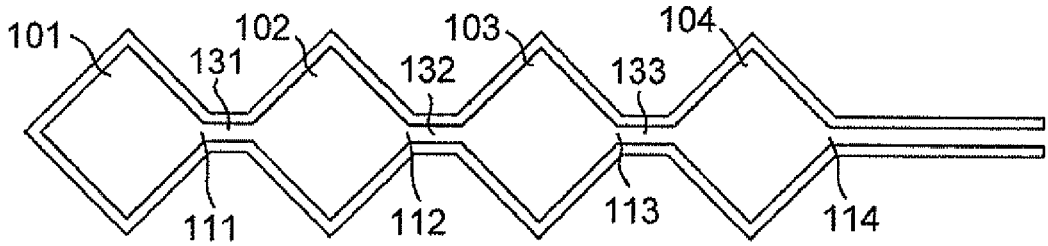

FIGS. 4A and 4B are schematic views showing other preferred example of the classifying device of the present exemplary embodiment. FIG. 4A is a perspective view and FIG. 4B is a sectional view taken along a line X-X' of FIG. 4A.

The classifying device 100 shown in FIGS. 4A and 4B is the same as the classifying device 100 shown in FIGS. 3A and 3B except that sectional forms of classifying passages 101, 102, 103 and 104 are different from those of the classifying device shown in FIGS. 3A and 3B.

In FIGS. 4A and 4B, the sectional form of the classifying passage is rectangular, and more specifically square, and an angular part is arranged so as to be directed downward.

The section is rectangular as shown in FIGS. 4A and 4B, so that coarse particle dispersion liquid may be more easily fed to a bully particle dispersion liquid discharge port and a classifying efficiency is preferably excellent.

(Method for Manufacturing Classifying Device)

Now, a method for manufacturing the classifying device of the present exemplary embodiment will be described below.

The classifying device of the present exemplary embodiment may be manufactured on a solid substrate by a micro machining technique.

As an example of a material used as the solid substrate, metal, Teflon (a registered trademark), glass, ceramics and plastic, etc. may be exemplified. Metal, silicon, Teflon (the registered trademark), glass and ceramics are preferable among them from the viewpoints of a heat resistance, a pressure resistance, a solvent resistance and a light transmission. The glass is especially preferable.

The micro machining technique for manufacturing a passage is described in, for instance, "Micro reactor—Synthesizing technique of new age—" (2003, published C.M.C, supervised by Junichi Yoshida), Micro machining technology, Application edition—Application to Photonics.Electronics.Mechatronics) (2003, published by N. T. S., Learned society of polymer (edited by event committee) or the like.

As representative methods, may be exemplified an LIGA technique using an X-ray lithography, a high aspect ratio photolithography method using EPON SU-8, a micro discharge machining method (μ-EDM), a high aspect ratio machining method of slicon by Deep RIE, a Hot Emboss machining method, an optical molding method, a laser machining method, an ion beam machining method and a mechanical micro cutting work method using a micro tool made of a hard material such as diamond. These techniques may be independently employed or may be combined together to be used. Preferable micro machining techniques are the LIGA technique using the X-ray lithography, the high aspect ratio photolithography method using EPON SU-8, the micro discharge machining method (μ-EDM) and the mechanical micro cutting work method.

The passage used in the present exemplary embodiment may be manufactured in such a way that a pattern formed by using a photo-resist on a silicon wafer is employed as a mold and the mold is filled with a resin to solidity the resin (a molding method). In the molding method, a silicon resin such as polydimethyl siloxane (PDMS) or derivatives thereof may be used.

Further, in the present exemplary embodiment, when the classifying device is produced, a connecting technique maybe used. An ordinary connecting technique is roughly classified into a solid-phase connection and a liquid-phase connection. In an ordinarily used connecting method, as the solid-phase connection, a connection under pressure method or a diffused connection method may be exemplified. As the liquid-phase connection, a welding method, a soldering method, a bonding method or the like may be exemplified as representative connecting methods.

Further, in the connection, a highly accurate connecting method is desirable which maintains a dimensional accuracy without the generation of a damage of a micro structural body such as the passage due to the decomposition or deformation of the material under heating at high temperature. As a technique thereof, may be exemplified a direct connection of silicon, an anode connection, a surface activating connection, a direct connection using a hydrogen bond, a connection using HFS aqueous solution, an Au—Si eutectic connection, a void free connection, a diffused connection or the like.

Since the passage of the classifying device of the present exemplary embodiment has a three-dimensional form, the classifying device is preferably formed by laminating pattern members (thin film pattern members). The thickness of the pattern member is 5 to 50 μm, and more preferably 10 to 30 μm.

The classifying device of the present exemplary embodiment is preferably formed by laminating the pattern members on which prescribed two-dimensional patterns are formed. The pattern members are preferably laminated under a state that the surfaces of the pattern members come into direct contact with each other and are connected together.

Plural pattern members respectively corresponding to sectional forms in the horizontal direction of the classifying device is preferably laminated to form the classifying device so that the classifying device may be simply formed.

As a preferred method for manufacturing the classifying device of the present exemplary embodiment, a method for manufacturing the classifying device may be exemplified that includes (i) a process for forming plural pattern members respectively corresponding to the sectional forms of a desired classifying device on a first substrate (a donor substrate manufacturing process) and (ii) a process for transferring the plural pattern members on the first substrate to a second substrate by repeating a connection and a separation of the first substrate on which the plural pattern members are formed and the second substrate (a connecting process).

The method for manufacturing the classifying device of the present exemplary embodiment will be more specifically described.

[Donor Substrate Manufacturing Process]

In the present exemplary embodiment, a donor substrate is preferably manufactured by using an electro-casting method. Here, the donor substrate indicates a substrate that the plural pattern members respectively corresponding to the sectional forms of the desired classifying device are formed on the first substrate. The first substrate is preferably formed with ceramics or silicon and metal such as stainless steel may be preferably suitably used.

Initially, the first substrate is prepared. A thick film photoresist is applied to the first substrate and exposed by photomasks respectively corresponding to the sectional forms of the classifying device to be manufactured, and the photoresist is developed to form a resist pattern in which positives and negatives of the sectional forms are respectively inverted. Then, the substrate having the resist pattern is immersed in a plating bath to allow, for instance, nickel plating to grow on the surface of the metal substrate that is not covered with the photo-resist. The pattern members are preferably formed with copper or nickel by using the electro-casting method.

Then, the resist pattern is removed to form the pattern members respectively corresponding to the sectional forms of the classifying device on the first substrate.

(Connecting Process)

The connecting process is a process for transferring the plural pattern members on the donor substrate to a target substrate by repeating the connection and the separation of the first substrate (the donor substrate) on which the plural pattern members are formed and the second substrate (the target substrate) The connecting process is preferably carried out by a connection at ordinary temperature or a surface activating connection.

FIGS. 5A to 5F show a production process diagram illustrating one exemplary embodiment of a manufacturing method of the classifying device preferably employed in a third exemplary embodiment.

Figure 5A:
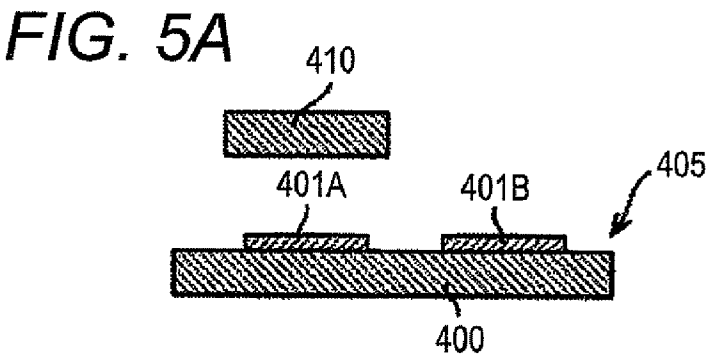
FIGS. 5A to 5F are schematic views showing manufacturing processes of the classifying device by a connecting method at an ordinary temperature.

As shown in FIG. 5A, on a donor substrate 405, plural pattern members (401A and 401B) respectively corresponding to the sectional forms of a desired classifying device is formed on a metal substrate 400 as a first substrate. The donor substrate 405 is arranged in a lower stage in a vacuum bath not shown in the drawing and a target substrate 410 is arranged in an upper stage in the vacuum bath not shown in the drawing. Subsequently, the vacuum bath is exhausted to have a high vacuum state or a super-high vacuum state. Then, the lower stage is moved relative to the upper stage to locate the pattern member 401A of a first layer of the donor substrate 405 immediately below the target substrate 410. Then, the surface of the target substrate 410 and the surface of the pattern member 401A of the first layer are irradiated with an argon atomic beam to clean the surfaces.

Figure 5B:
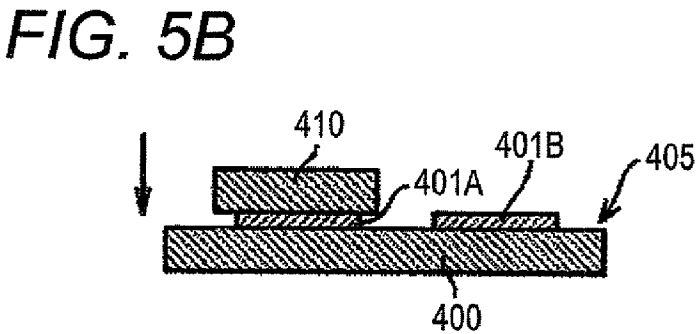

Then, as shown in FIG. 5B, the upper stage is lowered to press the target substrate 410 and the donor substrate 405 under a prescribed load force (for instance, 10 kgf/cm$^2$) for a prescribed time (for instance, 5 minutes). Thus, the target substrate 410 is connected to the pattern member 401A of the first layer at ordinary temperature (the surface activating connection). In this exemplary embodiment, the pattern members are laminated in order of the pattern members 401A, 401B, , , , .

Figure 5C:
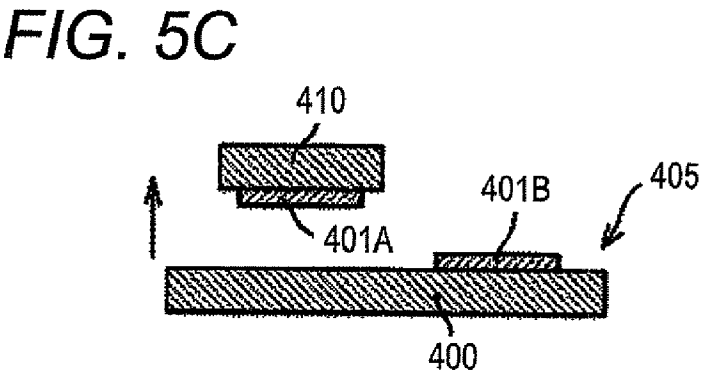

Then, as shown in FIG. 5C, when the upper stage is lifted to separate the donor substrate 405 from the target substrate 410, the pattern member 401A of the first layer is peeled off from the metal substrate (the first substrate) 400 and transferred to the target substrate 410 side. This phenomenon occurs, because the adherence force of the pattern member 401A to the target substrate 410 is larger than the adherence force of the pattern member 410A to the metal substrate (the first substrate) 400.

Figure 5D:
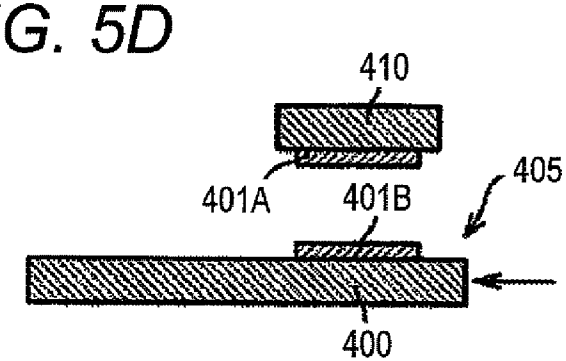

Then, as shown in FIG. 5D, the lower stage is moved to locate the pattern member 401B of a second layer of the donor substrate 405 immediately below the target substrate 410. Then, the surface of the pattern member 401A of the first layer (a surface in contact with the metal substrate 400) that is transferred to the target substrate 410 and the surface of the pattern member 401B of the second layer are cleaned as described above.

Figure 5E:
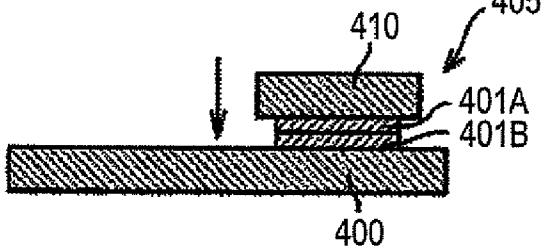
Figure 5F:
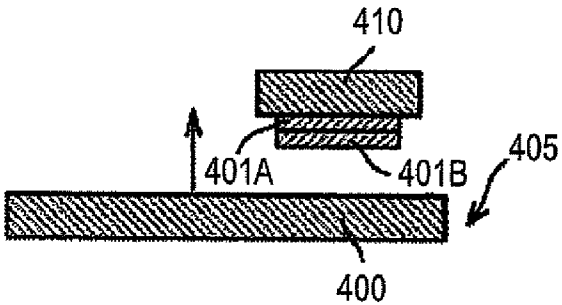

Then, as shown in FIG. 5E, the upper stage is lowered to connect the pattern member 401A of the first layer to the pattern member 401B of the second layer. As shown in FIG. 5F, when the upper stage is lifted, the pattern member 401B of the second layer is peeled off from the metal substrate (the first substrate) 400 and transferred to the target substrate 410 side.

Similarly, for other pattern members, the donor substrate 405 and the target substrate 410 are positioned and repeatedly connected to each other and separated from each other, so that plural pattern members respectively corresponding to the sectional forms of the classifying device are transferred to the target substrate. When a laminated body transferred onto the target substrate 410 is detached from the upper stage and the target substrate 410 is removed, the classifying device may be obtained.

In the above-described exemplary embodiment, the donor substrate is manufactured by using the electro-casting method. However, the donor substrate may be manufactured by using a semiconductor process. For instance, a substrate made of an Si wafer is prepared. A mold releasing layer made of polyimide may be formed on the substrate by a spin coating method, an AI thin film as a material forming the classifying device may be formed on the surface of the mold releasing layer by a sputtering method and the AI thin film may be patterned by a photolithography method to form the donor substrate.

EXAMPLE

The present exemplary embodiment will be described in more detail by using an example. However, the present exemplary embodiment is not limited to the below-described example.

In this example, the particles are classified by using the classifying device shown in FIGS. 1 and 2. In the classifying device shown in FIGS. 1 and 2, the entire lengths of the classifying passages are respectively set to 150 mm. Further, the classifying passage is a tubular shaped passage having a circular section with a diameter of 5 mm. The coarse particle dispersion liquid discharge port has a circular form with a diameter of 1 mm and the connecting passage from the coarse particle dispersion liquid discharge port also has a tubular form having a circular section with a diameter of 1 mm.

As the dispersion liquid A, aqueous dispersion liquid (15 wt %) of spherical particles of polymethyl methacrylate (PMMA) (produced by Sekisui Chemical Co., Ltd., Techpolymer) is used and fed at liquid transport speed of 40 ml/h. Reynolds number at this time is 3 in the laminar flow.

Figure 6:
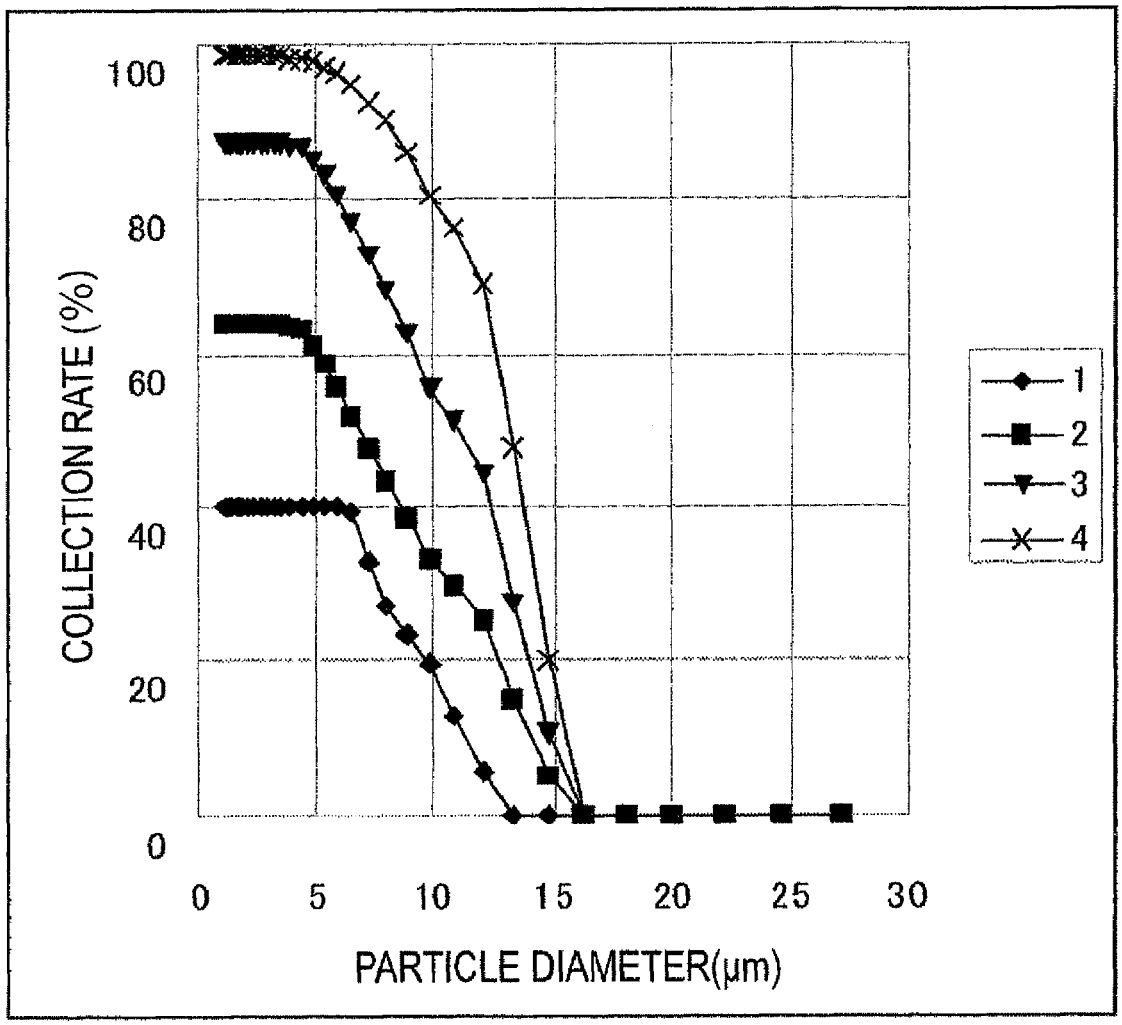
FIG. 6 is a diagram showing the collection rate of particles of an example 1.
Figure 7:
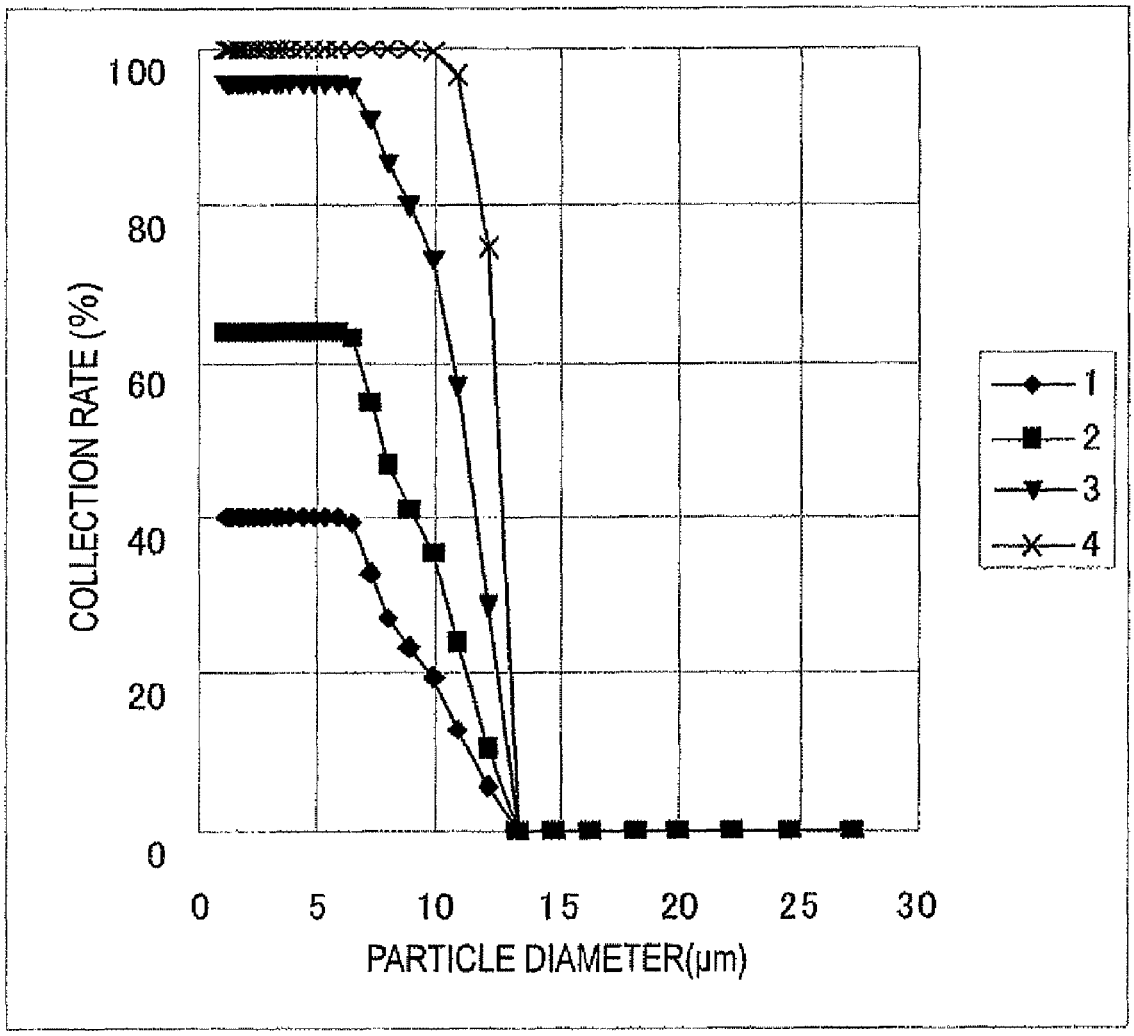
FIG. 7 is a diagram showing the collection rate of particles of an example 2.

The particles are classified continuously for three hours. A classified result at this time is shown in FIG. 6 and FIG. 7. FIG. 6 shows the result obtained by classifying the particles using the classifying device shown in FIG. 1. FIG. 7 shows the result obtained by classifying the particles using the classifying device shown in FIG. 2.

Now, FIG. 6 and FIG. 7 will be described below.

In the classifying devices shown in FIG. 1 and FIG. 2, the particle dispersion liquids discharged from the fine particle dispersion liquid discharge port and the coarse particle dispersion liquid discharge port are collected in such a way as described below.

Dispersion liquid (1) indicates the fine particle dispersion liquid discharged from the fine particle dispersion liquid discharge port of the first classifying passage.

Dispersion liquid (2) indicates the fine particle dispersion liquid discharged from the fine particle dispersion liquid discharge port of the second classifying passage.

Dispersion liquid (3) indicates the fine particle dispersion liquid discharged from the fine particle dispersion liquid discharge port of the third classifying passage.

Dispersion liquid (4) indicates the fine particle dispersion liquid discharged from the fine particle dispersion liquid discharge port of the fourth classifying passage.

Dispersion liquid (5) indicates the coarse particle dispersion liquid (total quantity) discharged from the coarse particle dispersion liquid discharge port of the fourth classifying passage.

A fraction (1) indicated by 1 in the drawing) shown in FIGS. 6 and 7 represents a collection rate of the particles in a first stage. That is, the collection rate of the first stage is expressed by a below-described equation in each particle diameter.

Collection rate (first stage) (%)=dispersion liquid (1)/(dispersion liquid (1)+dispersion liquid (2)+dispersion liquid (3)+dispersion liquid (4)+dispersion liquid (5))

Further, a fraction (2) (indicated by 2 in the drawing) represents a collection rate of the particles in a second stage. The collection rate of the second stage is expressed by a below-described equation in each particle diameter.

Collection rate (second stage) (%)=(dispersion liquid (1)+dispersion liquid (2))/(dispersion liquid (1)+dispersion liquid (2)+dispersion liquid (3)+dispersion liquid (4)+dispersion liquid (5))

Similarly, a fraction (3) (indicated by 3 in the drawing) and a fraction (4) (indicated by 4 in the drawing) respectively designate collection rates of the particles in a third stage and a fourth stage. The collection rates of the third stage and the fourth stage are respectively expressed by below-described equations in each particle diameter.

Collection rate (third stage) (%)=(dispersion liquid (1)+dispersion liquid (2)+dispersion liquid (3))/(dispersion liquid (1)+dispersion liquid (2)+dispersion liquid (3)+dispersion liquid (4)+dispersion liquid (5))

Collection rate (fourth stage) (%)=(dispersion liquid (1)+dispersion liquid (2))+dispersion liquid (3)+dispersion liquid (4)/(dispersion liquid (1)+dispersion liquid (2)+dispersion liquid (3)+dispersion liquid (4)+dispersion liquid (5))

As shown in FIG. 6, in the first stage, the collection rate of the particles having the particle diameter of 5 μm or smaller is more than 40%. The total collection rate of the first stage to the second stage is more than 60%. The total collection rate of the first stage to the third stage is about 95%. The total collection rate of the first stage to the fourth stage is substantially 100%.

Further, in the collected fine particle dispersion liquid, the mixture of the coarse particles (for instance, the particles having the particle diameter of 15 μm or larger) is not recognized and a good classifying efficiency is obtained.

In the example 1, the particle concentration of the dispersion liquid (1) is 21.7 wt %. The particle concentration of the dispersion liquid (2) is 14.3 wt %. The particle concentration of the dispersion liquid (3) is 9.8 wt %. The particle concentration of the dispersion liquid (4) is 6.9 wt %. Further, the particle concentration of the dispersion liquid (5) is 22.4 wt %.

On the other hand, in the example 2 having the circulating passages shown in FIG. 2, the particle concentration of the dispersion liquid (1) is 21.1 wt %. The particle concentration of the dispersion liquid (2) is 13 wt %. The particle concentration of the dispersion liquid (3) is 8.5 wt %. The particle concentration of the dispersion liquid (4) is 5.9 wt %. Further, the particle concentration of the dispersion liquid (5)) is 26.5 wt %. The results are shown in a below table.

TABLE 1

| | Particle concentration (wt %) | | Average particle Diameter (μm) | |
|---|---|---|---|---|
| | Example 1 | Example 2 | Example 1 | Example 2 |
| Particle dispersion liquid fed | 15.0 | 15.0 | 9.8 | 9.8 |
| Dispersion liquid (1) | 21.7 | 21.1 | 9.3 | 8.9 |
| Dispersion liquid (2) | 14.3 | 13.0 | 9.5 | 9.4 |
| Dispersion liquid (3) | 9.8 | 8.5 | 9.7 | 9.6 |
| Dispersion liquid (4) | 6.9 | 5.9 | 9.9 | 9.8 |

TABLE 1-continued

| | Particle concentration (wt %) | | Average particle Diameter (μm) | |
|---|---|---|---|---|
| | Example 1 | Example 2 | Example 1 | Example 2 |
| Dispersion liquid (5) | 22.4 | 26.5 | 10.5 | 10.7 |

FIG. 6 is compared with FIG. 7. When the classifying device of the example 1 having no circulating passages is used, even if four-stage processes are carried out, the collection rate of the particles having the particle diameter of about 5 to 10 μm does not reach 100%. Further, an absolute value of the inclination of the collection rate to the particle diameter is decreased. However, when the classifying device of the example 2 having the circulating passages is used, the collection rate to the particles having the particle diameter of about 5 to 10 μm reaches 100%. An inclination of the collection rate to the particle diameter is substantially vertical. When the circulating passages are provided as described above, the particle concentration of the dispersion liquid is supposed to be restrained from being high and the classifying efficiency is supposed to be restrained from being deteriorated due to a force between the particles.

When the device is set to an angle of 30° under the conditions of the example 1, the particle concentration of the dispersion liquid (1) is 31.5 wt %, the particle concentration of the dispersion liquid (2) is 17.8 wt %, the particle concentration of the dispersion liquid (3) is 10.3 wt %, and the particle concentration of the dispersion liquid (4) is 6.0 wt %. Further, the particle concentration of the dispersion liquid (5)) is 9.4 wt %.

Average particle diameter of the dispersion liquids are: 9.8 μm in the dispersion liquid (1); 9.7 μm in the dispersion liquid (2); 9.9 μm in the dispersion liquid (3); 10.1 μm in the dispersion liquid (4); and 10.5 μm in the dispersion liquid (5)), respectively. When the discharge of coarse powder is deteriorated, the classifying efficiency is more deteriorated than that of the example 1.

The foregoing description of the embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention defined by the following claims and their equivalents.

What is claimed is:

1. A classifying device having two or more classifying passages, the classifying device comprising:

a first classifying passage to which particle dispersion liquid is fed;

a plurality of discharge ports provided in the first classifying passage, the plurality of discharge ports including a plurality of coarse particle dispersion liquid discharge ports and a fine particle dispersion liquid discharge port;

a second classifying passage; and a plurality of connecting passages that transport coarse particle dispersion liquid to the second classifying passage from the first classifying passage via the plurality of coarse particle dispersion liquid discharge ports, wherein an average particle diameter of particles contained in the coarse particle dispersion liquid is larger than an average particle diameter of particles contained in the particle dispersion liquid fed to the first classifying passage, an average particle diameter of particles contained in fine particle dispersion liquid is smaller than the average particle diameter of the particles contained in the particle dispersion liquid fed to the first classifying passage, and the coarse particle dispersion liquid discharge ports are provided in more upstream part of the first classifying passage than the fine particle dispersion liquid discharge port.

2. The classifying device according to claim 1, wherein at least one of said two or more classifying passages has an inclination relative to a vertical direction.

3. The classifying device according to claim 1, wherein at least one of said two or more classifying passages has the discharge port of the coarse particle dispersion liquid, the discharge port of the fine particle dispersion liquid and a discharge port of dilution liquid, and a concentration of weight percentage of particles in the dilution liquid is lower than a concentration of weight percentage of the particles in the fine particle dispersion liquid.

4. The classifying device according to claim 3, wherein at least one of said two or more classifying passages has a circulating passage, the circulating passage transporting dilution liquid to the classifying passage having the circulating passage or other classifying passage and circulating the dilution liquid.

5. The classifying device according to claim 1, wherein, in at least one of said two or more classifying passages, a sectional area of passage in a downstream part is larger than a sectional area of the passage in an upstream part.

6. The classifying device according to claim 1, wherein the classifying device does not include an introducing port of transporting liquid.

7. The classifying device according to claim 1, wherein the first classifying passage has a particle dispersion liquid introducing port that introduces the particle dispersion liquid.

8. The classifying device according to claim 1, having two to ten classifying passages.

9. The classifying device according to claim 1, having four to seven classifying passages.

10. The classifying device according to claim 2, wherein an inclination angle of the classifying passage is larger than 0° and smaller than 90°.

11. The classifying device according to claim 2, wherein an inclination angle of the classifying passage is larger than 15° and smaller than 75°.

12. A classifying method comprising:

feeding particle dispersion liquid to a first classifying passage of a classifying device that includes a plurality of classifying passages;

classifying particles contained in the particle dispersion liquid while transporting the particle dispersion liquid through the first classifying passage, wherein a plurality of discharge ports are provided in the first classifying passage, and the plurality of discharge ports includes a plurality of coarse particle dispersion liquid discharge ports for discharging coarse particle dispersion liquid and a fine particle dispersion liquid discharge port for discharging fine particle dispersion liquid; and transporting at least one discharge liquid discharged from any one of the plurality of discharge ports to a second classifying passage, wherein an average particle diameter of particles contained in the discharge liquid transported to the second classifying passage is larger than an average particle diameter of the particles contained in the particle dispersion liquid fed to the first classifying passage, and the coarse particle dispersion liquid is transported via a plurality of connecting passages that transport the coarse particle dispersion liquid to the second classifying passage from the first classifying passage via the plurality of coarse particle dispersion liquid discharge ports.

13. The classifying method according to claim 12, further comprising:

transporting discharge liquid to at least one of the plurality of classifying passages, wherein the discharge liquid is discharged from the first classifying passage and has a particle concentration lower than that of the particle dispersion liquid fed to the first classifying passage; and circulating the discharge liquid.

14. The classifying method according to claim 12, wherein the first classifying passage to which the particle dispersion liquid is fed has an inclination relative to a vertical direction.

15. The classifying method according to claim 12, wherein the first classifying passage has a discharge port of coarse particle dispersion liquid and a discharge port of fine particle dispersion liquid, and $R_A$, $R_B$ and $R_C$ satisfy following formula:

$$R_C<R_A<R_B$$

wherein $R_A$ represents an average particle diameter of particles contained in the particle dispersion liquid fed to the first classifying passage;

$R_B$ represents an average particle diameter of particles contained in the coarse particle dispersion liquid discharged from the discharge port of the coarse particle dispersion liquid; and $R_C$ represents an average particle diameter of particles contained in the fine particle dispersion liquid discharged from the discharge port of the fine particle dispersion liquid.

16. The classifying method according to claim 12, wherein the first classifying passage has a particle dispersion liquid introducing port that introduces the particle dispersion liquid.

17. The classifying method according to claim 12, wherein the classifying device has two to ten classifying passages.

18. The classifying method according to claim 12, wherein the classifying device has four to seven classifying passages.

19. The classifying method according to claim 14, wherein an inclination angle of the first classifying passage is larger than 0° and smaller than 90°.

20. The classifying method according to claim 14, wherein an inclination angle of the first classifying passage is larger than 15° and smaller than 75°.

* * * * *